US010435207B2

(12) United States Patent
Gerbaulet et al.

(10) Patent No.: US 10,435,207 B2
(45) Date of Patent: Oct. 8, 2019

(54) COLLAPSIBLE FLUID DISPENSING PACKAGE AND VALVE FITMENT FOR DISPENSING FLUID SUCH AS FOODSTUFFS

(71) Applicant: NESTEC S.A., Vevey (CH)

(72) Inventors: Arnaud Gerbaulet, Oye et Pallet (FR); David Nordqvist, Lausanne (CH); Etienne Closset, Corcelles-Cormondreche (CH); Daniel Abegglen, Grandvaux (CH)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 15/573,557

(22) PCT Filed: Jun. 7, 2016

(86) PCT No.: PCT/EP2016/062858
§ 371 (c)(1),
(2) Date: Nov. 13, 2017

(87) PCT Pub. No.: WO2016/198380
PCT Pub. Date: Dec. 15, 2016

(65) Prior Publication Data

US 2018/0111725 A1 Apr. 26, 2018

(30) Foreign Application Priority Data

Jun. 8, 2015 (EP) ..... 15171003

(51) Int. Cl.
*B65D 75/58* (2006.01)
*B65D 47/20* (2006.01)

(52) U.S. Cl.
CPC ..... *B65D 47/2037* (2013.01); *B65D 47/2031* (2013.01); *B65D 75/5883* (2013.01); *B65D 2575/583* (2013.01)

(58) Field of Classification Search
CPC ..... B65D 47/2031; B65D 47/2037; B65D 75/5883; B65D 75/008; B65D 2575/583
(Continued)

(56) References Cited

U.S. PATENT DOCUMENTS 4,830,205 A * 5/1989 Hammond ..... A61J 9/005 215/11.1
6,273,307 B1 * 8/2001 Gross ..... B65D 75/5883 220/613
(Continued)

FOREIGN PATENT DOCUMENTS

CN 1327426 A 12/2001
CN 103702814 A 4/2014
(Continued)

OTHER PUBLICATIONS

Chinese Office Action for corresponding Chinese Application No. 201680031364.3, dated Nov. 9, 2018; (5 pages).

*Primary Examiner* — Charles Cheyney
(74) *Attorney, Agent, or Firm* — K&L Gates LLP

(57) ABSTRACT

The invention relates to a valve fitment (6; 60) for a collapsible fluid dispensing package for dispensing fluid by relative pressure present in the package; the valve fitment comprising: —at least a compressible wedge-like spout (9; 9', 9"); —a sealing base (10) arranged for sealing engagement with the container at a seal edge (5); wherein the wedge-like spout (9; 9', 9") is located within a passage (11; 11', 11") formed through the sealing base (10) and, wherein sealing base is preferably of higher rigidity than the wedge-like spout (9; 9', 9"). The invention also relates to a fluid dispensing package (1) comprising the valve fitment (6; 60).

16 Claims, 8 Drawing Sheets

(58) Field of Classification Search
USPC ..... 222/107, 92, 494, 490, 541.6, 566, 105
See application file for complete search history.

(56) References Cited

U.S. PATENT DOCUMENTS

| | | | | |
|---|---|---|---|---|
| 6,578,740 | B1 | 6/2003 | Hagihara | |
| 6,752,264 | B2 * | 6/2004 | Versluys | B65D 75/5883 206/219 |
| 7,021,505 | B2 * | 4/2006 | Franczyk | A21C 15/005 222/541.1 |
| 7,172,100 | B2 * | 2/2007 | Mertens | B65D 75/5883 222/547 |
| 9,073,248 | B2 * | 7/2015 | Smith | B29C 45/0046 |
| 9,309,032 | B2 * | 4/2016 | Berge | B65D 47/122 |
| 2008/0247684 | A1 * | 10/2008 | Binks | B65D 47/2031 383/113 |
| 2017/0225852 | A1 * | 8/2017 | Ohkubo | B65D 47/36 |
| 2017/0275089 | A1 * | 9/2017 | Perentes | B65D 75/5883 |
| 2017/0275090 | A1 * | 9/2017 | Dubesset | B65B 43/02 |

FOREIGN PATENT DOCUMENTS

| | | | |
|---|---|---|---|
| NL | 1013647 | | 5/2001 |
| WO | 9962784 | A1 | 12/1999 |
| WO | 9962785 | | 12/1999 |
| WO | 2007139906 | A2 | 12/2007 |

* cited by examiner

COLLAPSIBLE FLUID DISPENSING PACKAGE AND VALVE FITMENT FOR DISPENSING FLUID SUCH AS FOODSTUFFS

CROSS REFERENCE TO RELATED APPLICATIONS

The present application is a National Stage of International Application No. PCT/EP2016/062858, filed on Jun. 7, 2016, which claims priority to European Patent Application No. 15171003.5, filed on Jun. 8, 2015, the entire contents of which are being incorporated herein by reference.

FIELD OF THE INVENTION

The invention relates to a collapsible fluid dispensing package for dispensing fluid, in particular, for viscous fluid. The invention relates more particularly to package comprising a valve fitment for controllably and hygienically dispensing fluid to a dedicated area such as a recipient. The invention further relates to a valve fitment for a package.

BACKGROUND

U.S. Pat. No. 6,131,806 relates to a dispensing structure incorporating a valve-containing fitment for mounting to a container and a package with a dispensing structure. The dispensing structure is a multi-piece fitment including a base for mounting to the container and a valve carrier for mounting to the base. A flexible self-sealing slit-type valve is further mounted to the fitment. A removable and disposable cover can extend from the container over the fitment. The cover can be pulled away from the container to expose the fitment. Such dispensing structure is very complex. The valve is not sealed and liquid can be easily leak in the intermediate space between the valve and the closing membrane and/or cover.

EP2386040B1 relates to a duckbill cap fitment for a collapsible container. Opening of the valve is obtained by introducing a probe in axial direction through the cap duckbill. The valve is relatively complex. In addition, for sensitive foodstuffs, the probe must initially be cleaned (e.g., aseptic) before it is introduction. The valve can be damaged by the probe during introduction and consequently not reclose well after its removal thereby leading to possible leakage.

A low cost hermetically sealed liquid-containing bag is described in U.S. Pat. No. 8,028,860B2 more particularly dedicated for dispensing drinks and the like. The bag formed of two hermetically closed chambers and comprising an integrally welded drinking spout or dispensing spout. The drinking or dispensing spout is a wedge-like spout that is sealingly welded in the separating strip of the two closed chamber. In the opened condition, the spout connects both chambers. The first bag chamber is envisaged for receiving the fluid, whilst the other bag chamber as a protective chamber encompasses and sealingly closes the outer spout end.

A problem of such prior art solution is that the spout remains very sensitive to mechanical solicitations, such as compressive forces, that can easily lead to fluid being pumped out of the main bag chamber into the protective chamber before manual opening of the protective bag. As a result, fluid can spread all over the outer surface of the spout or even fill the protective chamber which may cause a messy delivery once the protective bag is opened by the user.

EP1084062B1 relates to an opening/closing device in particular for container with flexible wall and container with flexible wall associated with the device. In particular, the device comprises a tubular nozzle piece made from deformable material and suitable for being fixed to the container by one end and having at the other end two parallel lips determining a rectilinear pouring slot. A further tubular guide is associated with the nozzle which comprises means arranged to cooperate with the nozzle in order to force the lips of the slots into separated positions. The breaking of the nozzle piece is obtained by moving the tubular guide that also serves as a cover. A problem is that any manipulation of the container (e.g., such as placing the nozzle downwards), after the tubular guide is activated, may cause leaking of product out of the nozzle.

There is a need for an improved simple package solution for which risk of leakage or spillage of fluid is reduced and which enables a good control of the dispense of fluid during the dispensing operation. In particular, there is a need for a clean and secured package solution that enables a safe transport and supply chain and that can be possibly treated aseptically.

SUMMARY OF THE INVENTION

The problem of the invention is resolved by a collapsible fluid dispensing package according to claim 1.

The invention is further defined by the dependent claims providing additional or complementary advantages.

In particular, the invention relates to a collapsible fluid dispensing package for dispensing fluid by relative pressure present in the package comprising a container for containing fluid comprising at least one seal edge and a valve fitment sealed to said seal edge of the container. The valve fitment comprises at least a compressible wedge-like spout. The valve fitment further comprises a sealing base in sealed engagement with the container at the seal edge. A passage is provided in or through the sealing base of the valve fitment and the wedge-like spout is located within the passage. Furthermore, the passage is preferably hermetically closed from the exterior by at least one flexible wall of the container which is sealed onto the sealing base. Preferably, the sealing base is preferably of higher rigidity than the wedge-like spout.

As a result, the collapsible fluid dispensing package embeds a wedge-like spout which is protected both mechanically and hygienically from the surroundings. In particular, the position of the spout inside the seal base associated to the rigidity of such base relative to the spout enable to reduce the risk of the wedge-like spout to be accidentally forced open. The passage enables also the wedge-like spout to be accessed by external mechanical means such as at least one pusher.

The "relative pressure present in the container" refers to a certain positive pressure created inside the container for forcing the fluid outside of the container such as by the application of external compressive forces onto the wall of the container, such as by a roller or piston and/or pulling a vacuum from outside of the valve fitment.

The term "hermetically" relates in the present application to the properties of imperviousness to liquid unless otherwise mentioned.

In the present application, the term "fluid" refers essentially to liquid or viscous paste or gel, or a mixture of any one of liquid, viscous, paste, gel with gas and/or discrete solid pieces, particles, granules, beads, chips and the like.

In a preferred aspect, the passage extends in a direction that is substantially orthogonal to the general plane of extension of the seal edge of the container. The sealing base preferably comprises sealing surfaces for sealing with the container at the seal edge and the wedge-like spout is placed in the passage in recess relative to the sealing surfaces of the sealing base. In other words, the sealing base extends from the passage orthogonally to the direction of the seal edge beyond each side of the wedge-like spout. As a result, the wedge-like spout remains protected and unsealed with the at least one flexible wall.

Preferably, the passage has an opening on at least one side of the sealing base; said opening being closed by a flexible wall of the container. Most preferably, the passage has an opening on each side of the sealing base; each opening being closed by a flexible wall of the container.

As a result, the wedge-like spout can be mechanically accessed via the passage, such as by at least one pusher from at least one side of the container thereby ensuring an opening of the spout. If the passage is a through-passage (i.e. traversing the sealing base from one side to the other), the wedge-like spout can even be mechanically accessed by two pushers, from the each side of the container. The opening of the spout can be even more facilitated.

In addition, the sealing base preferably extends from the passage along the direction of the seal edge beyond each side of the wedge-like spout. The wedge-like spout is thereby protected from a possible distortion/deformation of the container, in particular, relative to the plane of the seal edge.

In particular, the sealing base can be formed as a boat-type fitment portion, with the plane of the seal edge preferably passing through the median plane of the boat-type fitment portion. The passage is thereby provided through the sealing base orthogonally to the median plane, at the longer width of the boat-type fitment portion.

In a possible mode, the sealing surfaces of the sealing base are formed of a series of transversal ridges. The ridges preferably extend orthogonally from a median portion of wall of the fitment. Transversal ridges may be arranged to delimit the passage. For example, the median portion of wall is traversed by the passage, where the wedge-like spout sits, and the passage is further delimited outwardly by, e.g., four, transversal ridges extending on each side of the median portion of wall.

In another possible mode, the sealing surfaces of the sealing base are formed of incurved walls of boat-like profile and a central passage is provided in the centre of the sealing base for the wedge-like spout.

In one general aspect, the wedge-like spout comprises a free tapered end. The free tapered end comprises a lip line oriented in the direction of extension of the passage across the sealing base. The lip line is capable of opening or enlarging to form an opening. In particular, when a pressure is exerted on each side of the wedge-like spout such as by at least one pusher, preferably two pushers, the lip line is forced to deform for providing an opening for the fluid delivery.

Preferably, the lip line is initially hermetically closed or sealed before use. Therefore, no leakage of fluid is enabled before the spout is actively forced in opening. Before the first use of the package, especially during storage, the dispensing package is therefore fully liquid-tight.

Preferably, the lip line is sealed or closed by forming a line of weakness relative to rest of the spout, and which is broken by exerting a mechanical pressure onto the spout along the direction of extension of the lip line or of the passage (i.e., which is substantially aligned with the lip line). The line of weakness is preferably linear. However, other forms of the lip line can be envisaged such as a cross-like form or an undulated form.

The wedge-like spout comprises at least one pressure-bearing surface extending substantially orthogonally to the lip line and being positioned on one side of the spout facing one opening of the passage. Preferably, the wedge-like spout comprises a pair of pressure-bearing surfaces; each surface extending substantially orthogonally to the lip line and being positioned on each side of the spout facing each opening of the passage.

The pressure-bearing surfaces may have various possible shapes. Preferably, the surfaces have a substantially triangular or trapezoidal shape.

According to another aspect, the valve fitment preferably comprises a fluid flow guiding member protruding from the sealing base. The flow guiding member has the function of guiding the flow of fluid towards one privileged direction or two or more privileged directions.

For instance, the fluid may be guided to a recipient such as a cup where the fluid is collected, eventually for further processing, e.g., mechanical (stirring or whipping) and/or heat processing (cooling or heating).

In a mode, the flow guiding member forms a portion of tube which is open towards the exterior of the container. The length of the tube is determined depending on the distance between the container and the position of the collecting recipient, e.g., between 10-40 mm. For example, if the fluid dispensing package is placed with the flow guiding member oriented downwards, in a fluid dispensing apparatus, the tube may be designed accordingly with a straight or incurved design. The tube may also be designed with a tapered free end to direct the flow of fluid in a more focused/restricted direction. Conversely, the tube may be designed with a flared free end to disperse the flow outwardly.

The flow guiding member can be closed by a removable closure member. For instance, the closure member can be a cap that is connectable to dispensing end of the tube. The cap can be connected by any suitable means such as a thread or clipping or press-fitting connection.

In a preferred arrangement, the valve fitment is formed of a single piece made integrally of the same material. In particular, the material for the valve fitment can be made of any thermoplastic material. Preferably, the material can be chosen amongst the group consisting of: polyolefins such a PE, PP and their copolymers or terpolymers.

The fluid can be foodstuff such as a dairy or beverage liquid composition or ice cream mix.

Depending on the type of fluid, e.g., foodstuff or medicine, the interior of the package including the valve fitment can be aseptically treated.

The fluid dispensing package may be further formed of gas barrier material and sealed in a gas-tight manner.

The invention also relates to a valve fitment for a collapsible dispensing package as defined previously.

In particular, the invention relates to a valve fitment for a collapsible fluid dispensing package for dispensing fluid by relative pressure present in the package; the valve fitment comprising:

- at least a compressible wedge-like spout;
- a sealing base arranged for sealing engagement with the container at a seal edge;
- wherein the wedge-like spout is located within a passage formed in or through the sealing base.

Preferably, the sealing base is of higher rigidity than the wedge-like spout.

Preferably, the sealing base comprises sealing surfaces for sealing with the container at the seal edge and wherein the wedge-like spout is placed in the passage in recess relative to the sealing surfaces of the sealing base.

The valve fitment may further comprise the characteristics presented previously in relation to the dispensing package.

The invention further relates to a system comprising a mechanical actuation device comprising first and second clamps with clamping surfaces which are dimensioned and shaped complementarily to engage the sealing base of the valve fitment and to position the valve fitment in a predetermined referential position and at least one of said surfaces, preferably both surfaces, comprising at least an actuation member which is arranged to engage and open the wedge-like spout.

BRIEF DESCRIPTION OF THE DRAWINGS

Further details, objects and advantages of the invention will become evident for a skilled person when reading the following detailed explanations of embodiments of the invention when taking in conjunction with the figures of the enclosed drawings.

DETAILED DESCRIPTION

Figure 1:
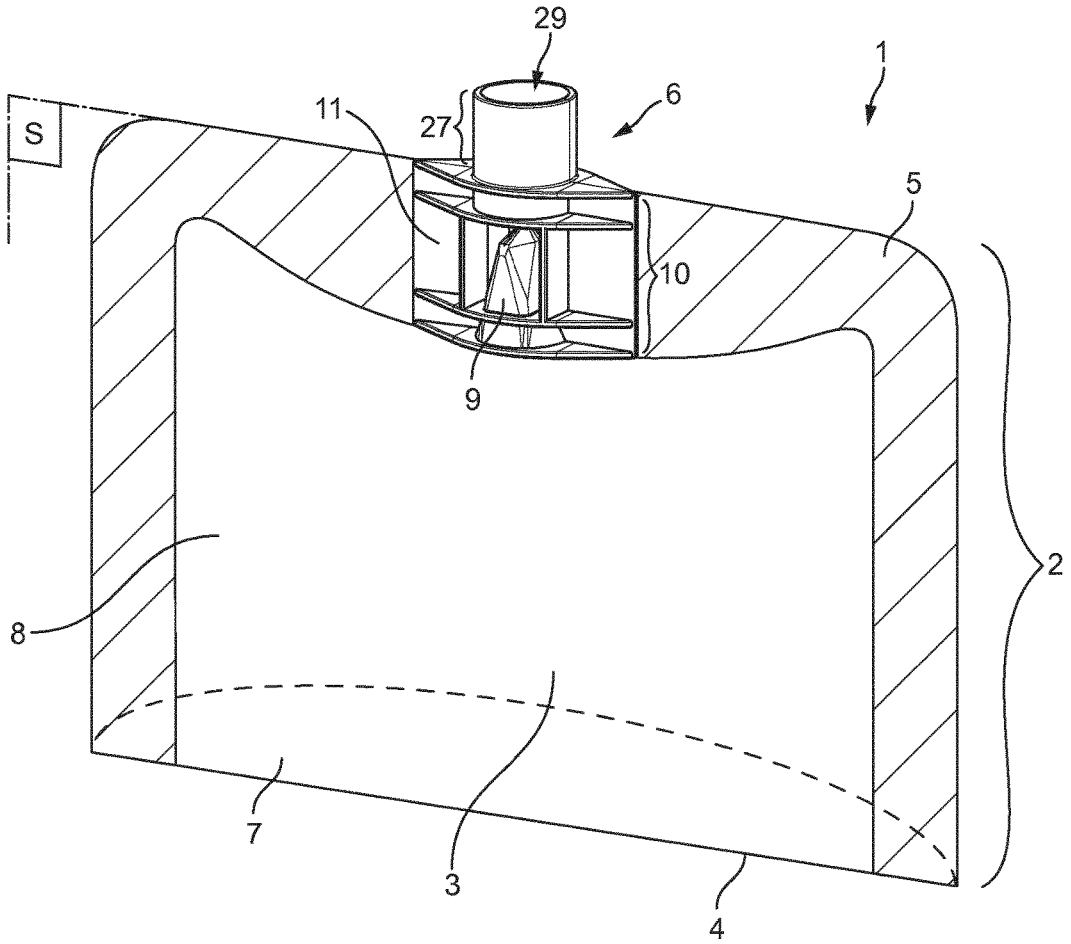
FIG. 1 is a schematic perspective view of the package of the invention.
Figure 2:
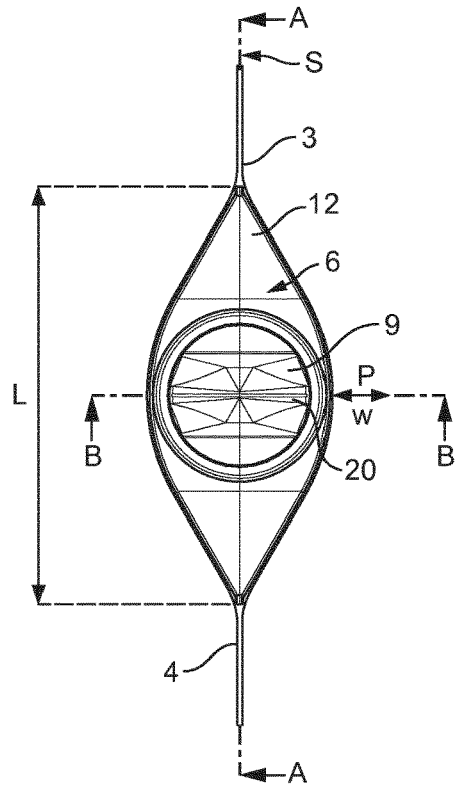
FIG. 2 is a plane partial cross-sectional view of the package of FIG. 1 (taken along line C-C of FIG. 4)
Figure 3:
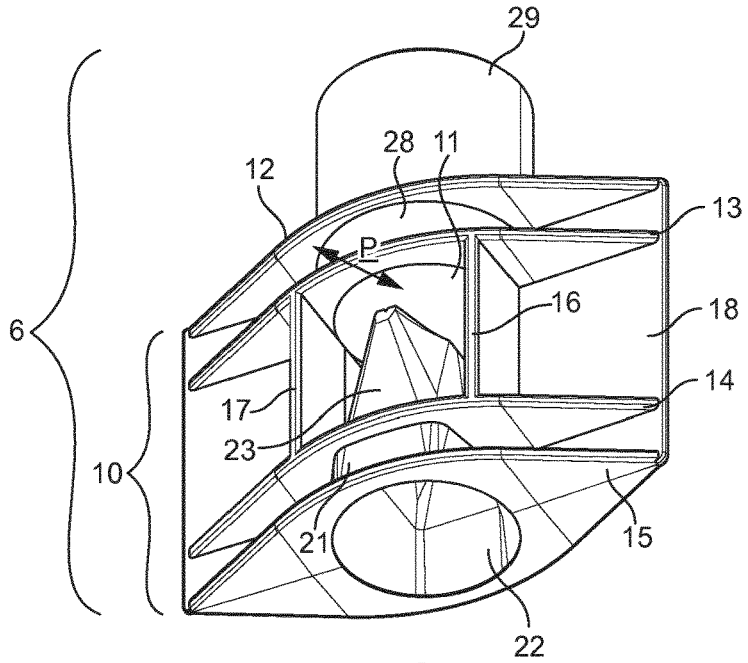
FIG. 3 is a perspective view of the valve fitment as such.
Figure 4:
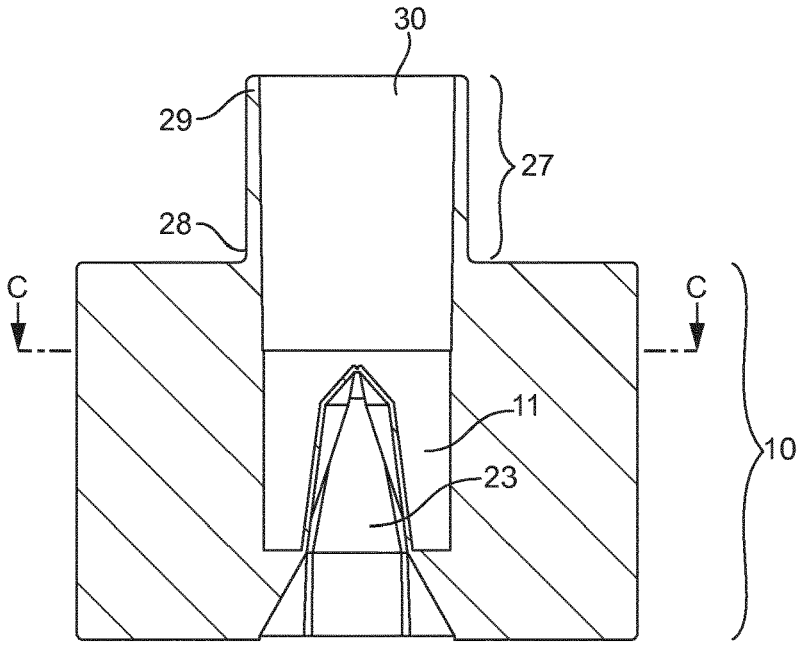
FIG. 4 is a cross-sectional view of the valve fitment taken in the direction A-A of FIG. 2.

The collapsible fluid dispensing package present invention according to a first embodiment is illustrated generally in relation to FIGS. 1 to 6.

The package 1 comprises a container 2 that is generally a flexible pouch or semi-flexible package. The embodiment is described in relation to a doypac-type container. However, other containers can possibly be used. The container comprises a front wall 3 and a rear wall 4 which are sealed (e.g., welded) together along a seal edge 5. The package comprises a valve fitment 6 that is sealed (e.g., welded) at the seal edge 5. The valve fitment may be positioned at a location that is substantially opposite to a third wall 7 of the container that is sealed to both first and second walls 3, 4. The third wall 7 provides good stability in a standing position with the third wall serving as bottom wall while having the possibility to fold as the container is emptied from its fluid content thereby contributing to a reduced occupied volume when the container is emptied. Of course, a container with only a front and second walls (but without third wall) can be used. The container and valve fitment demarcate a sealed internal cavity 8 for containing the fluid.

The position of the valve fitment is not critical and may dependent on the specific fluid dispensing applications. In the illustrated embodiment, the fitment may be triangularly shaped such that the cavity 8 narrows down progressively towards the valve fitment. However, other designs of the seal edge are possible such as a rectangular seal edge with a fitment positioned centrally or a seal edge that is truncated at a corner with a fitment placed at this corner.

As shown in FIGS. 2 to 5, the valve fitment 6 comprises a compressible wedge-like spout 9 and a sealing base 10. The wedge-like spout is also known as a duckbill valve. A passage 11 is formed through the sealing base 10 to house the wedge-like spout 9. The sealing base is of higher rigidity than the spout 9 so that it protects the spout and prevents its accidental (manual) opening.

In the preferred mode, the sealing base 10 is formed as a boat-type fitment portion. The fitment comprises thus a longer dimension L intended to extend in the median plane S of extension of the seal edge of the container. It also comprises a larger width w oriented perpendicularly to said same direction. The width of the fitment progressively diminishes from the center towards the two ends of the sealing base.

The sealing base 10 is delimited outwardly by seal surfaces for sealing with the front and rear walls 3, 4 of the container. In the illustrated mode (FIG. 3), the seal surfaces form a series of transversal ridges 12-17 extending on each side of the sealing base 10. Preferably, the transversal ridges 12-17 extend orthogonally from a median portion of wall 18. The portion of wall 18 extends longitudinally along the direction of the longer dimension L of the fitment and in the median plane S of the seal edge of the container. Such skeleton configuration provides a high rigidity of the sealing base compared to the wedge-like spout.

In addition, portions of the most central ridges 13, 14, 16 delimit the central passage 11 for access to the wedge-like spout. The ridges 13, 14, 16 extend beyond the wedge-like spout in the orthogonal direction. Therefore, the wedge-like spout 9 is placed in the passage in recess relative to the sealing surfaces of the sealing base.

The front and rear walls 3, 4 of the container are sealed on the sealing base to the seal surfaces, i.e., transversal ridges 12-17. In particular, the passage 11 is covered and so imperviously closed by the container's walls 3, 4. Furthermore, the wedge-like spout 9, as positioned in recess, relative to the seal surfaces, becomes orthogonally distant from the walls 3, 4 and is thus not directly sealed to these walls. In addition, the sealing tension of the walls 3, 4 on the fitment must be such that a certain pressure is necessary to be exerted until the wedge-like spout can be contacted. Therefore, manual accidental opening can be successfully prevented.

Figure 6:
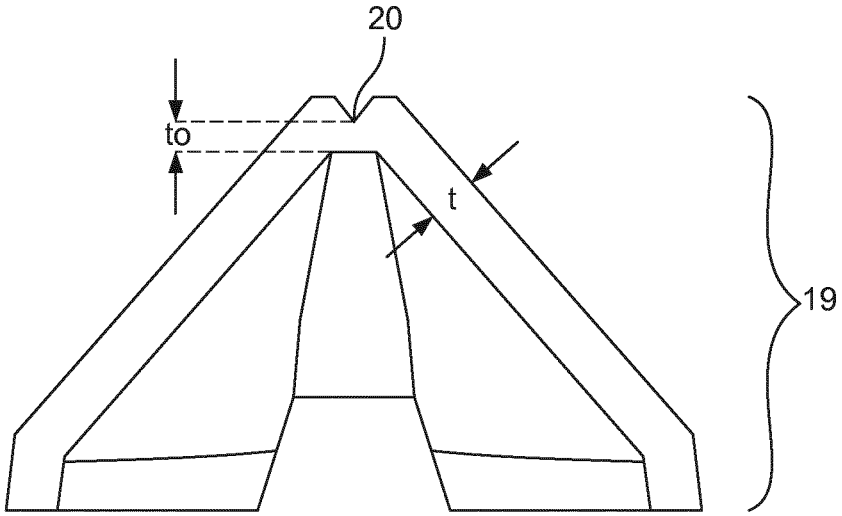
FIG. 6 is an enlarged cross-sectional view of detail of FIG. 4 showing in particular the free tapered end of the wedge-like spout.

The wedge-like spout 9 may preferably comprise a free tapered end 19 (FIG. 6). This end 19 comprises a lip line 20 oriented in the direction of extension (P) of the passage across the sealing base. The lip line is thus also orthogonal to the longer dimension L of the valve fitment. Preferably, the lip line is initially hermetically closed or sealed before use as illustrated on FIG. 6. It comprises a line of weakness, preferably rectilinear. For this, the thickness $t_0$ of the line's wall is made smaller than the thickness t of the walls of the spout outside the lip line. For example, $t_0$ may be 1.5 to 3 times smaller than t. The lip line can be dimensioned to break when a mechanical pressure is exerted on the wedge-like spout, such as in a privileged direction. In particular, this privileged direction corresponds to the direction of extension the lip line and the same as the one of the passage.

The opposite end 21 of wedge-like spout is connected to the sealing base 10, i.e., to the innermost transversal ridge 15. A fluid inlet opening 22 is provided in the sealing base for enabling fluid to enter the wedge-like spout.

Figure 5:
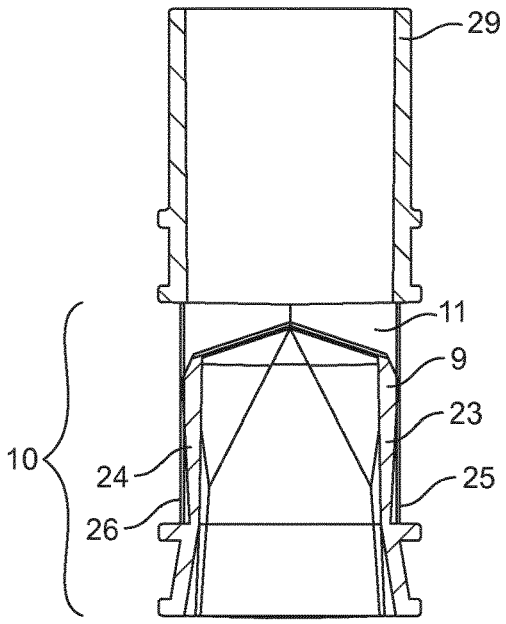
FIG. 5 is cross-sectional view of the valve fitment taken in the direction B-B of FIG. 2.

The wedge-like spout further comprises a pair of pressure-bearing surfaces or walls 23, 24. These surfaces are positioned orthogonally to the lip line and positioned on each side of the valve spout. The pressure-bearing surfaces are positioned towards the openings 25, 26 of the passage 11 so that they are accessible from external mechanical actuation members (FIGS. 5, 12*b*, 12*c*). The pressure-bearing surfaces may have various shapes. Preferably, the surfaces are relatively flat and have a substantially triangular or trapezoidal shape. This configuration ensures a good transmission of the forces for opening/breaking the lip line of the spout, as well as a wide opening of the spout.

The valve fitment preferably further comprises a fluid flow guiding member 27. The guiding member may be a portion of tube with a first end 28 connected to the sealing base 10, in particular to the outermost transversal ridge 12, and a second or free end 29. At its first end 28, the tubular guiding member communicates with the passage 11. At its free end 29, the portion of tube comprises a fluid delivery outlet 30.

The valve fitment can be formed of one single piece. In particular, the wedge-like spout 9, the sealing base 10 and the guiding member 27 are formed as one single monolithic piece made of the same material. In particular the valve fitment can be moulded in one piece by plastic-injection.

Of course, the valve fitment can also be formed of two or more pieces. For instance, the wedge-like spout can be a separate piece which is connected to the sealing base.

Figure 7:
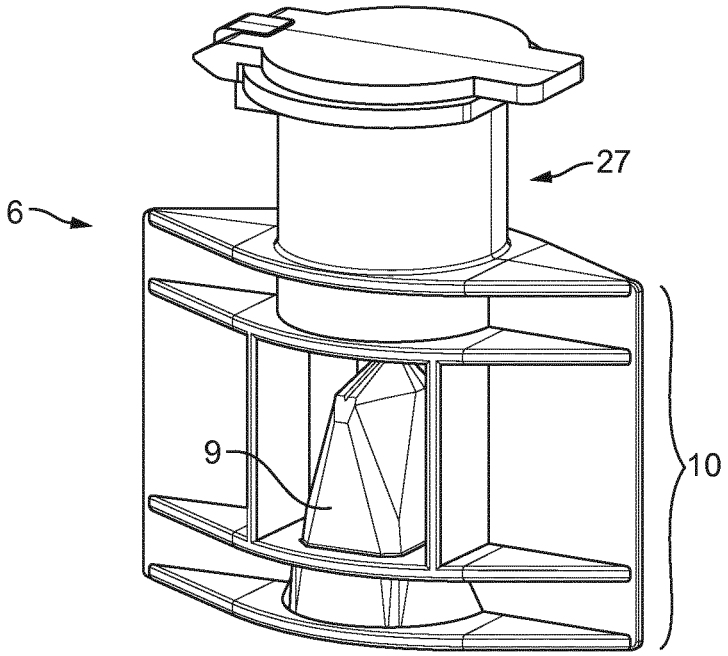
FIG. 7 is a perspective view of the valve fitment according to a second embodiment.
Figure 8:
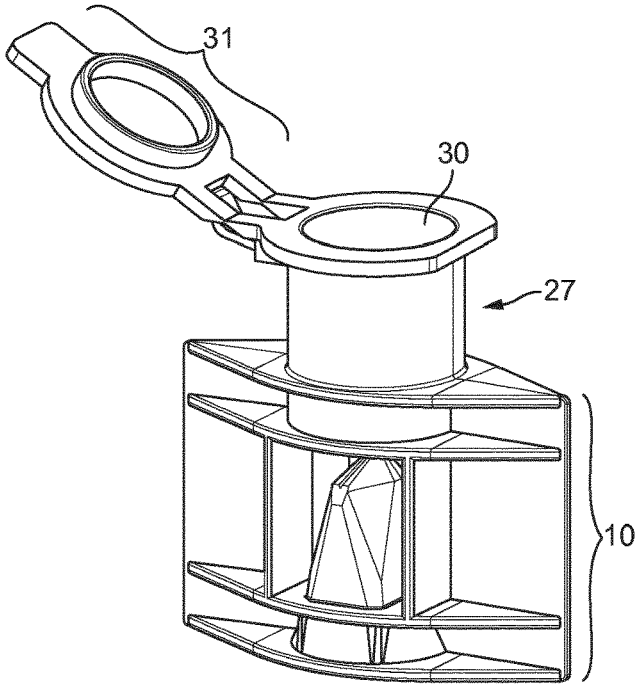
FIG. 8 is a perspective view of the valve fitment of FIG. 7 with the cover cap being disengaged (in fluid dispensing mode)
Figure 9:
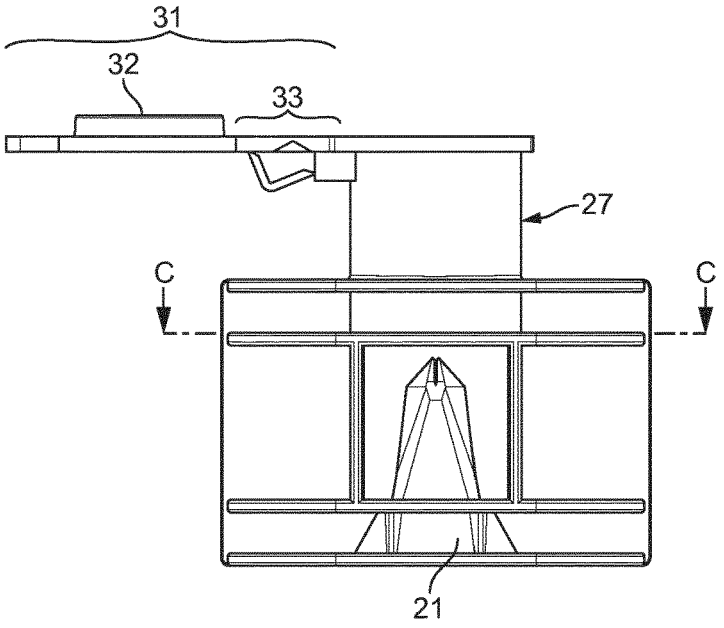
FIG. 9 is a side view of the valve fitment of FIGS. 7 and 8.

A second possible embodiment is illustrated on FIGS. 7 to 9. This embodiment differs from the first embodiment only in that the fluid flow guiding member 27 comprises a closure member 31. The closure member comprises a cap 32 configured to close the fluid delivery outlet 30. The cap 32 can be mounted to the portion of tube by a hinge 33 so enabling the cap to take reversible open and closed positions (FIGS. 8 and 7 respectively). For economical reasons, the valve fitment can also be formed of a single piece including the closure member.

Of course, other possible variants are possible. For example, the closure member can be a cap comprising a thread portion to be screwed on a complementary thread portion of the tubular portion. The flow guiding member 27 may also be closed by a pull-off closing membrane.

Figure 10:
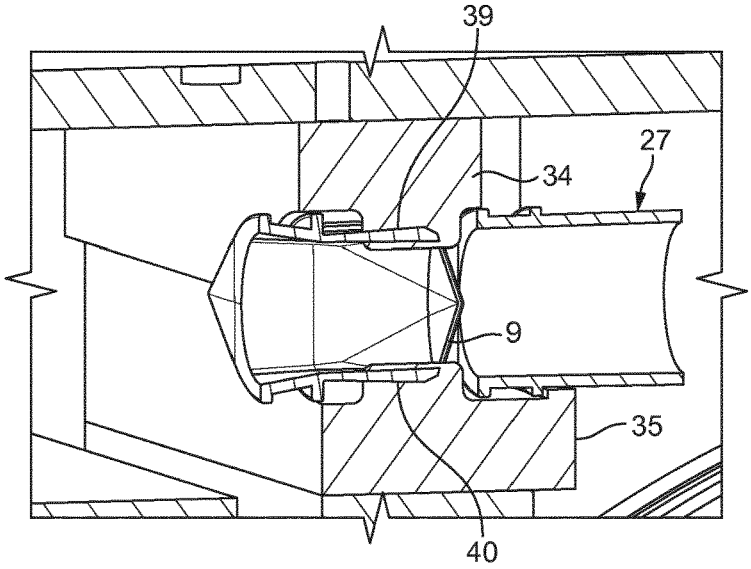
FIG. 10 shows the valve fitment when engaged by an external mechanical actuation device.
Figure 11A:
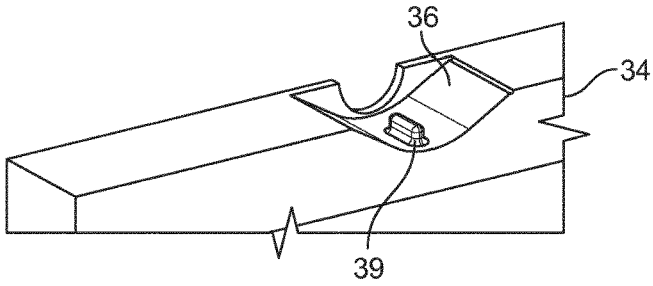
FIG. 11*a*, 11*b* shows details of the external mechanical device.
Figure 11B:
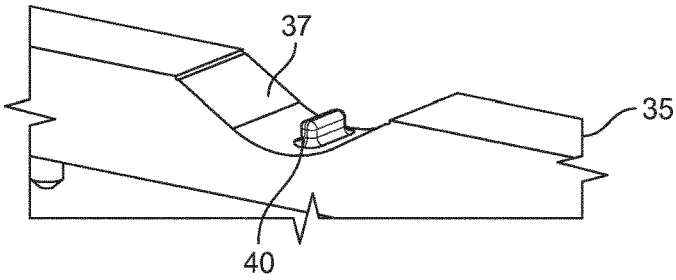
Figure 12A:
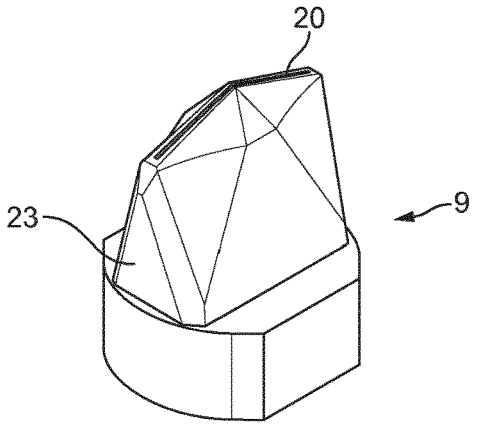
FIG. 12*a* shows a wedge-like spout of the spout fitment of the invention in closure configuration.
Figure 12B:
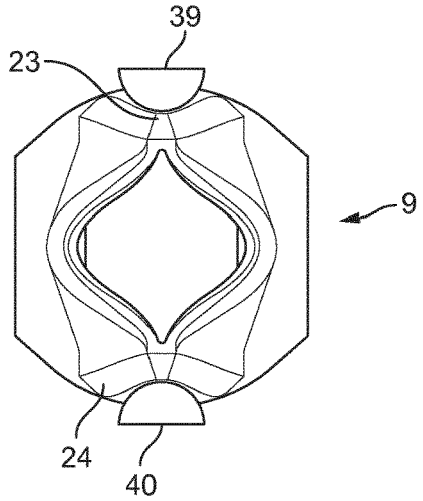
FIG. 12*b* shows a plane view of a wedge-like spout of the valve fitment of the invention in opened configuration when engaged in opening by pushers.
Figure 12C:
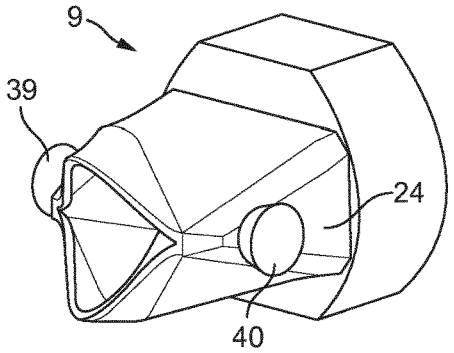
FIG. 12*c* shows a perspective view of a wedge-like spout of the valve fitment of the invention in opened configuration when engaged in opening by pushers.

The following FIGS. 10-12 show an example of the valve fitment interaction with an external mechanical actuation device. The mechanical actuation device may comprise first and second clamps 34, 35 comprising clamping surfaces 36, 37 which are dimensioned and shaped complementarily to engage the sealing base 10 and position the valve fitment in a predetermined referential position. As shown, the clamping surfaces are generally shaped to tightly fit the boat-type profile of the fitment.

In addition, each surface 36, 37 comprise an actuation member 39, 40 which is arranged to engage the pressure-bearing surfaces 23, 24 of the wedge-like spout. The actuation members 39, 40 may be a series of pins protruding from the clamping surfaces 36, 37. The pins may be formed as stationary passive elements relative to the clamps 34, 35. In such case, the opening of the spout is obtained directly by the engagement of the clamps against the valve fitment.

In a possible alternative (not shown), the pins are mounted retractable relative to the clamping surfaces 36, 37. The pins can be further actively driven in a protruding position of engagement with the spout by external drive means such as solenoids. In such case, the opening of the spout is carried out independently from the engagement of the clamping surfaces with the valve fitment. In particular, the pins can be moved into engagement with the spout after the valve fitment has been engaged by the clamps 34, 35.

It should be noted that the external mechanical actuation device could be provided with only a single actuation member, with e.g. a single pin, for opening the valve fitment.

The valve fitment of the invention may also be a stand-alone part which can be used with a refillable container.

Figure 13A:
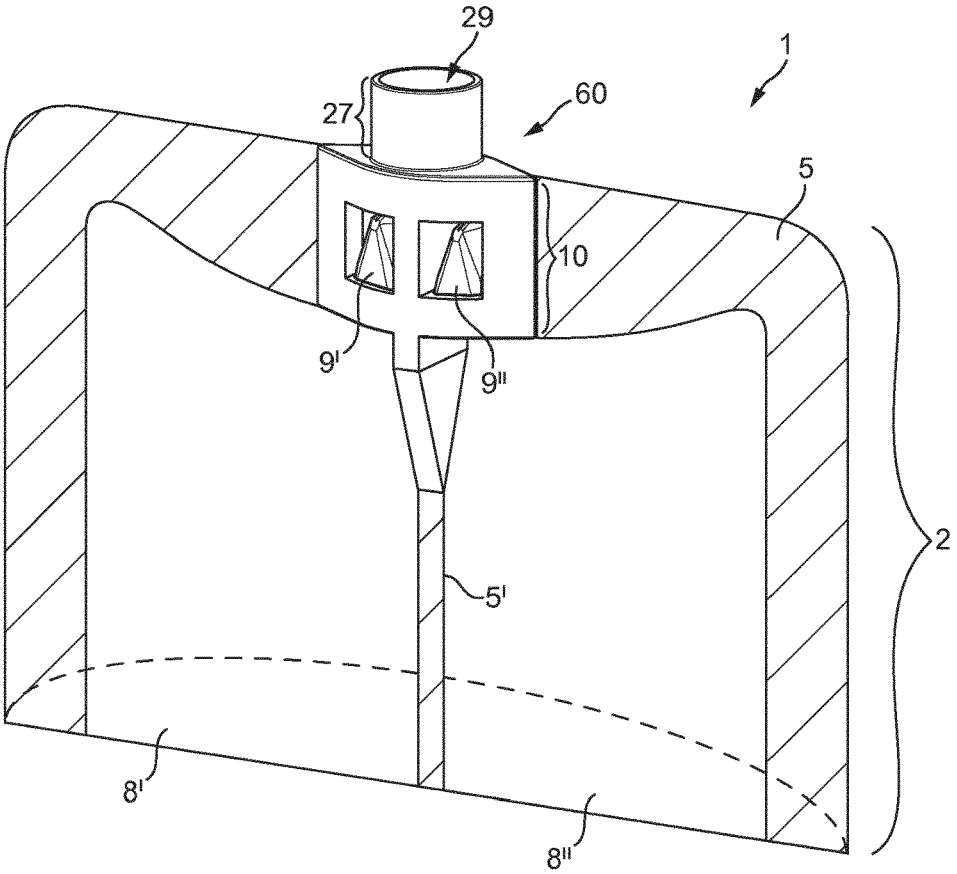
FIG. 13*a* is a schematic perspective view of the package of the invention according to another possible embodiment.
Figure 13B:
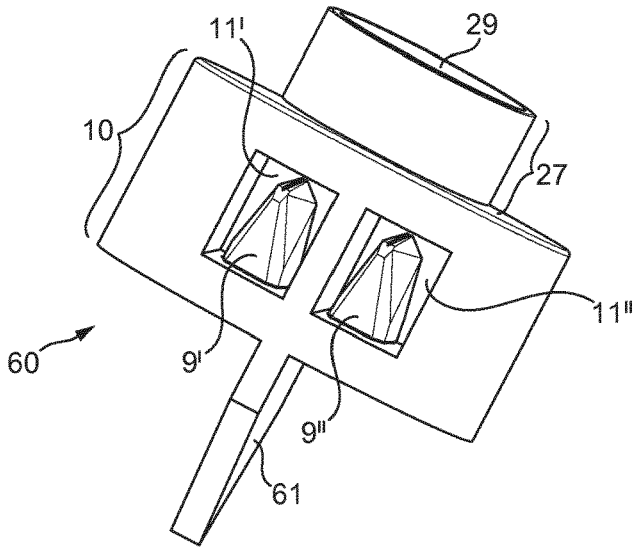
FIG. 13*b* is a perspective view of the valve fitment of the package in FIG. 13*a*.

Another possible embodiment of the present invention is shown in FIGS. 13*a* and 13*b*, showing a package 1 comprising a container 2 also having a front wall 3 and a rear wall 4 which are sealed (e.g. welded) together along a seal edge 5. The package comprises a valve fitment 60 that is sealed (e.g. welded) at the seal edge 5. According to this embodiment, the container and valve fitment demarcate two sealed primary and secondary internal cavities, 8' and 8", for containing the fluid. The container 2 is sealed at an intermediate part along a seal edge 5' which allows creating the two cavities 8' and 8", together with a central part 61 of the valve fitment 60.

As shown in FIG. 13*a* and in more detail in FIG. 13*b*, the valve fitment 60 comprises two compressible wedge-like spouts 9' and 9" and a sealing base 10.

The wedge-like spout is also known as a duckbill valve. Similarly to the other executions shown, corresponding passages 11' and 11" are formed through the sealing base 10 to house the wedge-like spouts 9' and 9", respectively. Also, the sealing base is of higher rigidity than the spouts 9' and 9" so that it protects the spouts and prevents their accidental (manual) opening.

As shown in any of FIG. 13*a* or 13*b*, the valve fitment 60 further comprises a fluid flow guiding member 27 and a free end 29 through which the fluid is delivered.

With the package and the valve fitment embodiments shown in FIGS. 13*a* and 13*b*, a dual chamber pouch is obtained preventing product contamination during storage and/or during product dispensing.

As the valve fitment 60 comprises dual spout 9' and 9", such a configuration allows delivering the product in either specific sequence or at the same time, simply by controlling the activating on the spouts 9' and 9" separately. For example, one spout can be activated while the other one is not, or both are activated at the same time, or cycles are done according to predefined desired sequences. Besides, such a valve fitment 60 configuration, can also be produced from one piece, allowing lower cost, lower environmental impact and smaller packaging.

The invention claimed is:

1. A collapsible fluid dispensing package for dispensing fluid by relative pressure present in the collapsible fluid dispensing package, the collapsible fluid dispensing package comprising:

a container for containing the fluid, and the container comprising at least one seal edge, a valve fitment sealed to the at least one seal edge of the container; the valve fitment comprising a compressible wedge-like spout, the valve fitment further comprises a sealing base in sealed engagement with the container at the at least one seal edge, the compressible wedge-like spout is located within a passage formed in or through the sealing base, the passage is hermetically closed from an exterior by at least one flexible wall of the container sealed onto the sealing base, the sealing base comprises a fluid flow guiding member comprising a tube comprising a first end positioned in an interior of the sealing base to fluidly connect with the passage, the tube further comprising a second end extending from the sealing base into the exterior of the container, and the compressible wedge-like spout is positioned in the interior of the sealing base between the first end of the tube and a side of the sealing base opposite from the first end of the tube, and wherein at least one side of the sealing base has an opening providing access into the passage, the opening being closed by the at least one flexible wall of the container, such that the at least one flexible wall of the container defines a wall of the passage over the opening.

2. The collapsible fluid dispensing package according to claim 1, wherein the sealing base comprises sealing surfaces for sealing with the container at the at least one seal edge, and the compressible wedge-like spout is placed in the passage in recess relative to sealing surfaces of the sealing base.

3. The collapsible fluid dispensing package according to claim 1, wherein the passage extends in a direction substantially orthogonal to a general plane of extension of the at least one seal edge of the container.

4. The collapsible fluid dispensing package according to claim 1, wherein the sealing base is formed as a boat-type fitment portion.

5. The collapsible fluid dispensing package according to claim 1, wherein the compressible wedge-like spout comprises a free tapered end which comprises a lip line oriented in a direction of extension of the passage across the sealing base that is capable of opening or enlarging to form an opening.

6. The collapsible fluid dispensing package according to claim 5, wherein the lip line is initially hermetically closed or sealed before use.

7. The collapsible fluid dispensing package according to claim 5, wherein the compressible wedge-like spout comprises at least one pressure-bearing surface.

8. The collapsible fluid dispensing package according to claim 1, wherein the fluid flow guiding member protrudes from the sealing base.

9. The collapsible fluid dispensing package according to claim 8, wherein the second end of the tube comprises a fluid delivery outlet.

10. The collapsible fluid dispensing package according to claim 1, wherein the valve fitment is formed of a single piece made integrally of the same material.

11. The collapsible fluid dispensing package according to claim 1, wherein the fluid is a foodstuff, and an interior of the collapsible fluid dispensing package is aseptically treated.

12. A valve fitment for a collapsible fluid dispensing package for dispensing fluid by relative pressure present in the collapsible fluid dispensing package, the valve fitment comprising:

a compressible wedge-like spout;

a sealing base arranged for sealing engagement with a container at a seal edge;

wherein the compressible wedge-like spout is located within a passage formed through the sealing base, the sealing base is of greater rigidity than the compressible wedge-like spout, the sealing base comprises a fluid flow guiding member comprising a tube comprising a first end positioned in an interior of the sealing base to fluidly connect with the passage, the tube further comprising a second end extending from the sealing base into an exterior of the container, and the compressible wedge-like spout is positioned in the interior of the sealing base between the first end of the tube and a side of the sealing base opposite from the first end of the tube, the passage is hermetically closed from the exterior by at least one flexible wall of a container sealed onto the sealing base, and wherein at least one side of the sealing base has an opening providing access into the passage, the opening being closed by the at least one flexible wall of the container, such that the at least one flexible wall of the container defines a wall of the passage over the opening.

13. The valve fitment according to claim 12, wherein the sealing base comprises sealing surfaces for sealing with the container at the seal edge, the compressible wedge-like spout is placed in the passage in recess relative to the sealing surfaces of the sealing base.

14. The collapsible fluid dispensing package according to claim 1, wherein the sealing base comprises seal surfaces forming transversal ridges extending on each side of the sealing base.

15. The collapsible fluid dispensing package according to claim 14, wherein the transversal ridges extend orthogonally from a median portion of a wall of the container extending longitudinally along a dimension of the valve fitment and in a median plane of the at least one seal edge of the container.

16. The collapsible fluid dispensing package according to claim 14, wherein the transversal ridges comprising central ridges, portions of the central ridges delimit the passage for access to the compressible wedge-like spout, and the central ridges extend beyond the compressible wedge-like spout in an orthogonal direction.

* * * * *